United States Patent [19]

Brandtberg

[11] 4,077,536

[45] Mar. 7, 1978

[54] BOTTLE CAP WITH REMOVABLE PLASTIC INSERT

[75] Inventor: Kai Brandtberg, Valby, Denmark

[73] Assignee: Bradfoss Anpartsselskab, Copenhagen, Denmark

[21] Appl. No.: 730,673

[22] Filed: Oct. 7, 1976

[51] Int. Cl.[2] ..... B65D 41/12

[52] U.S. Cl. ..... 215/228; 40/311; 215/341; 24/90 TA; 24/103

[58] Field of Search ..... 215/227, 228, 349, 350, 215/341; 40/311, 315; 24/90 R, 90 E, 90 TA, 103

[56] References Cited

U.S. PATENT DOCUMENTS

| | | | |
|---|---|---|---|
| 2,175,029 | 10/1939 | Richmond | 24/90 TA |
| 2,480,262 | 8/1949 | Purinton | 24/90 E |
| 2,582,721 | 1/1952 | Roshkind | 215/228 X |
| 2,901,796 | 9/1959 | Hope | 24/90 R |

FOREIGN PATENT DOCUMENTS

| | | | |
|---|---|---|---|
| 526,174 | 6/1956 | Canada | 215/341 |
| 850,869 | 9/1970 | Canada | 24/90 R |
| B25,311 | 5/1956 | Germany | 24/90 R |
| 792,336 | 3/1958 | United Kingdom | 24/103 |

*Primary Examiner*—Donald F. Norton

*Attorney, Agent, or Firm*—Wegner, Stellman, McCord, Wiles & Wood

[57] ABSTRACT

A plastic insert for sealing caps such as Crown Corks which is capable of forming a seal impermeable to liquid when it is pressed by the cap against the beaded mouth of a container. The insert comprises a central projection directed towards the interior of the container. This projection may comprise a transverse hole and/or a longitudinal hole rendering it possible to apply by means of a drawing pin or a safety pin or sew by means of a needle the insert onto a blouse or a display card board. In this manner the insert may be used as a trimming thus offering a certain advertisement to the manufacturer of the contents of the container.

21 Claims, 25 Drawing Figures

Figure 8:
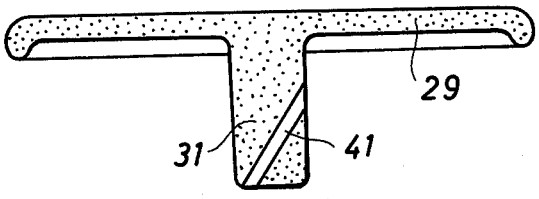

Fig. 1
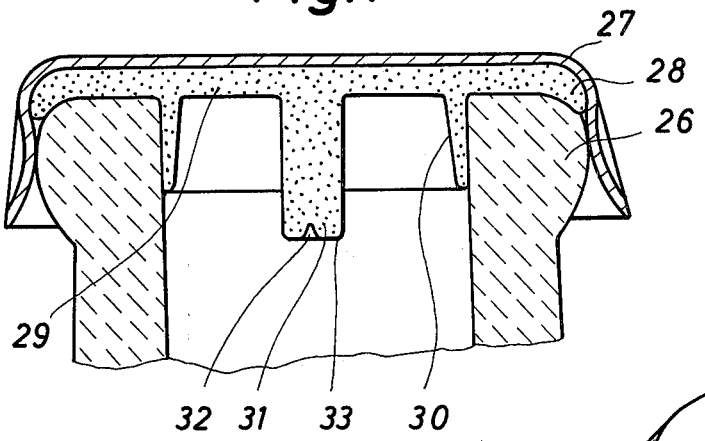
Fig. 2
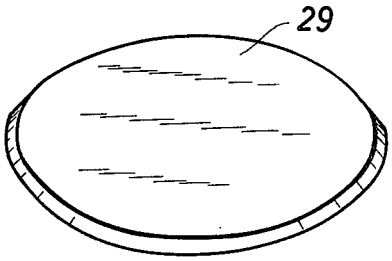
Fig. 4
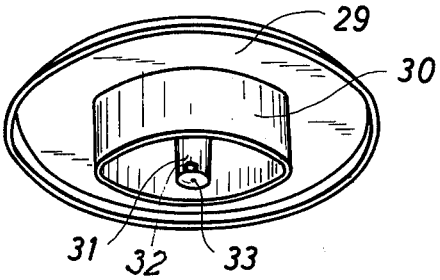
Fig. 3
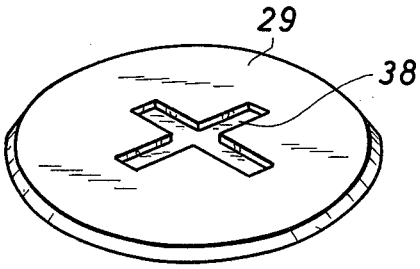
Fig. 6
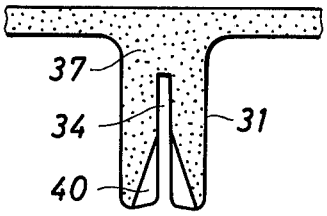
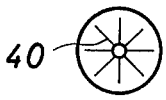
Fig. 7
Fig. 5
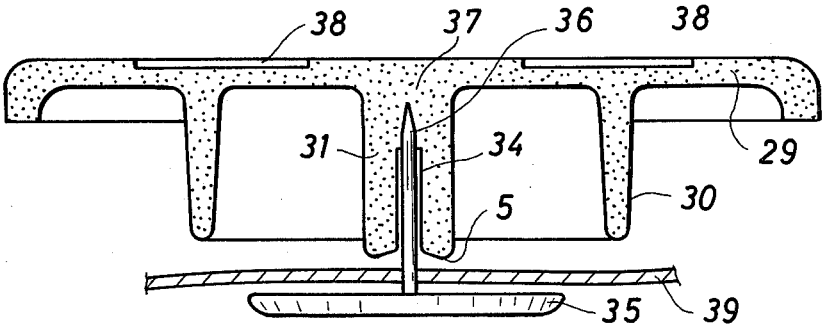

BOTTLE CAP WITH REMOVABLE PLASTIC INSERT

It is known to provide container closures such as sealing caps for bottles with a plastic insert comprising a central projection in the shape of a solid cylinder. The insert of a Crown Cork has previously been provided with a central projection turning away from the bottle and being secured to the central portion of the metallic cap of the Crown Cork. In this manner the projection of the insert increases the capability of the central portion of withstanding the pressure in the bottle.

The object of the present invention is to permit a new and further use of an insert comprising a projection, when the Crown Cork has been detached from the container and the insert removed from the metallic cap.

According to the invention the projection is situated on the side of the insert facing the container, and directed towards the interior of the container and is provided with a hole for catching and cooperating with the pin point, a separate pin tool to penetrate the projection for fixing purposes. This renders it possible to use the insert as trimming by sewing it on or securing it to a blouse by means of a safety pin stuck through the projection. A drawing pin may also be stuck through the blouse or shirt and into the end portion of the projection of the insert. The insert may thus be used as a button in the blouse.

Children and young people may use such buttons as trimmings, which look well on a blouse or a shirt with their various colours and imprints, and e.g. arranged in a pattern.

The insert may also be used as a distinctive mark or a participant's emblem, and, when provided with a sign or some information, the insert may thus indicate that the wearer belongs to a certain group of persons.

As to re-use the insert may serve as a collector's item. In this connection it is advantageous that the collector may display on his shirt the emblems he wants to have exchanged. In this manner the manufacturer of the inserts of the container obtains a certain advertisement.

In order to facilitate the arrangement of the plastic insert as a trimming on a blouse or a shirt the projection may according to the invention be provided with a through hole for receiving and cooperating with a separate securing means, such as e.g. the drawing pin or saftey pin. As described below, a ring, a thread, a nail or a thin stick may, however, also be used as securing means.

According to a preferred embodiment of the plastic insert according to the invention the hole may be as narrow as a pinhole. Thus the insert or the cap used as a trimming can be secured to the fabric by means of a needle carried through the hole, thus preventing the button from hanging loosely down.

The hole may be cast, but in general it is preferred to form the hole after the casting, either before or after the subject has left the mould.

Whether the hole is stuck or drilled it would facilitate its manufacture if according to the invention the hole is made in a planar side wall of the projection.

According to the invention the hole may furthermore be located on the projection where the latter is formed as a lamella and has a thickness of the same magnitude as the other parts of the insert, the hole extending the shortest way through the projection. By forming the projection in this manner sufficient material about the transverse hole is ensured without necessitating penetration of particularly massive wall portions.

By letting the hole according to the invention extend obliquely through the projection, it is possible to secure the trimming by means of a drawing pin, a nail, a safety pin or by sewing it on.

In this case the advantage is obtained that the hole may according to the invention extend from an oblique end surface of the projection, said surface being at right angles to the axis of the hole.

Moreover according to the invention the end surface of the projection may be planar with rounded edges, thus providing good rest for the head of a drawing pin or a nail, whether there is a hole or not in the projection, and simultaneously sharp edges are avoided which might collect dirt during the capping operation.

Furthermore according to the invention the hole may be a small depression in the free end of the projection in order that the latter may cooperate with a drawing pin or a nail, the depression thereby catching the point of the securing means and carrying said point into the solid portions of the projection.

Besides, the end of the projection may according to the invention be formed as a funnel-shaped depression ending in a hole as narrow as a pinhole. This depression possesses particularly good possibilities of catching the point of the securing means and of carrying the point through the hole down into the solid portions of the projection.

According to a special embodiment of the invention the projection may comprise a thick, solid portion at its base, and the depression may extend into an axial hole adjacent said solid portion.

In order to make the projection press very resiliently against the leg of the drawing pin, thus facilitating the introduction of said pin, the projection may according to the invention be provided with a plurality of radial slits extending from the depression and the outermost portion of the hole.

According to another embodiment of the insert the hole may according to the invention comprise an oblique extension leading through the side of the projection, and an enlargement in the side of the mouth of the hole at the end surface of the projection, said enlargement being coaxial with the extension. By means of a hole thus formed the lower solid portion of the projection may be used for cooperation with the securing means, or the button may be sewed on a piece of fabric, e.g. a garment.

If beyond the above advantages it is desired to make the projection with a minimum of material, the cross section may according to the invention decrease towards its free end portion.

According to another material-saving embodiment of the invention the projection may have the shape of a truncated conical body with an elliptical normal section. This implies a particularly short hole to be drilled since the hole may follow the conjugated axis of one of the cross-sectional ellipses.

Moreover according to the invention the height of the projection may be somewhat larger than the length of a drawing pin. The drawing pin will then penetrate the main part of the solid bottom portion before the trimming is firmly secured.

In order to protect the projection against scratches from the edge of other sealing caps when a large number of caps with inserts are situated in a common container in a capping machine, the inserts of the caps have been provided with a cylindrical sleeve sealing at the interior surface of the bottleneck. If it is desired to use an insert with such a sleeve the sleeve should according to the invention be less projecting than the projection, since the hole in the projection may thereby be arranged in such manner that the sleeve does not get in the way of the needle when the button is to be sewed on a piece of fabric.

The insert may according to the invention be formed in such manner that the projection comprises both a central depression in its free end surface and a transverse hole. The depression or the transverse hole may then, as occasion requires, be used depending on the securing means available.

The projection according to the invention may also be formed in such manner that it comprises both a central longitudinal hole and a transverse hole, both offering the same advantages.

Besides, the cross section of the longitudinal hole may according to the invention be out or round, such as oval, rectangular, rhombical or clover-leaf shaped, and the transverse hole may extend in or adjacent the thinnest wall portions of the longitudinal hole. The unrounded form provides the wall of the longitudinal hole with various thicknesses, and the above situating of the transverse hole renders it possible to make the transverse hole in the shortest possible time.

Moreover, the longitudinal hole needs not have the same cross section all over its length, but may according to the invention in addition to a very narrow inner portion comprise a wider conical portion with for instance a star-shaped cross section towards the free end of the projection, and the transverse hole may then cross said conical hole portion. By making the longitudinal hole wider towards the free end of the projection it is ensured that the hole easier catches the drawing pin or the nail, if the trimming is to be secured by such a securing means, and simultaneously thin portions are formed in the wall of the longitudinal hole through which the transverse hole may be carried.

The transverse hole in the projection may be manufactured by moulding, but it is more inexpensive and quicker to produce the transverse hole by pressing the material out of the projection by means of a small punch or a blanking die.

A preferred method of making the transverse hole in the projection of the plastic insert is according to the invention to use a cannula, since this tool will remove only so much material that a needle with a thread may be carried through the hole.

Furthermore according to the invention it would be an advantage to use a cannula obliquely cut at its end for the manufacture of the transverse hole, the cutting edge of the cannula not only pressing against the material, but also cutting its way through said material. Such a cannula is not worn so much as a cannula having its edge situated in a normal section.

The quickest way of producing the transverse hole is according to the invention by cutting the hole by means of a helically moved cannula. The cutting edge of such a cannula will be cut rather than pressed through the material. The plug cut out of the material by the cannula will neither fall out of the cannula after drilling nor stick to a short burr along the outlet edge of the hole as in the previous two cases, but will be retained completely in the cavity of the cannula. This the plug is prevented from following the insert and later on from being washed into the liquid or the paste in the container.

The transverse hole in the projection may according to the invention be cut or drilled with a cannula situated in one of the mould portions before the mould is opened after casting of the insert. Thus it is rendered possible to remove a finished insert from the mould.

According to the invention the same is obtainable if the transverse hole of the projection is cut or drilled by means of a cannula after the mould upon casting has been opened so as to permit exposure of part of the projection, the projection itself not being disengaged from any of the mould portions. The cannula may then be introduced into the gap between the mould portions in order to perform the hole cutting, while the projection is still in the mould. By this method the burrs may be removed from the drilling point.

The most advantageous method of making the transverse hole is according to the invention to produce the transverse hole outside the mould so that the mould will not be occupied during the operation period. According to the invention the transverse hole may be drilled while the insert is pressed onto a stand on a conveyor, the insert being for instance also provided with coloured imprints with information or decoration when resting on said stand, said conveyor also supporting a holder with a bearing for a chuck holding the cannula, the rotary movement to the cannula being transmitted through a friction pulley arranged on said chuck, said friction pulley cooperating with a friction chute, the axial movement of the cannula being provided by a curved guide pressing against the free end of the chuck and a counter spring as the conveyor is passing along the guide.

As mentioned above it is practical to support the cannula within the mould during the production of the transverse hole, and according to the invention the mould may comprise two coaxial holes the first of which being situated adjacent the projection of the insert and having a diameter corresponding to the cross section of the cannula, said first hole supporting the cannula during its introduction, and the second hole opposite the first hole, the wall of said second hole serving as a support for the cannula.

Finally according to the invention the inlet hole may have a diameter being somewhat larger, approximately 0.04 mm, than the outer diameter of the cannula, and the outlet hole may have a diameter being still a little larger, approximately 0.1 mm. These measures of the holes in the mould will offer good support for the cannula, and it is possible with one and the same cannula to drill a very large number of holes before the cannula is to be sharpened. The drilling operation requires only 1 sec.

Figure 9:
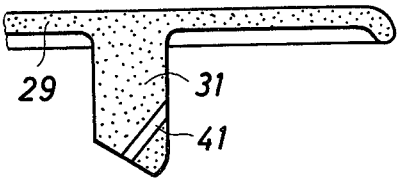
Figure 10:
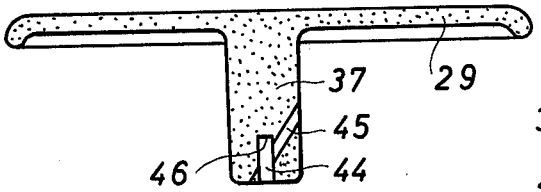
Figure 13:
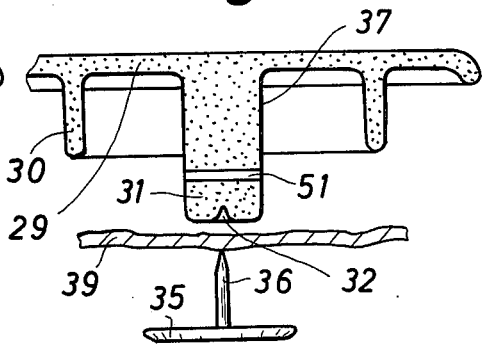
Figure 11:
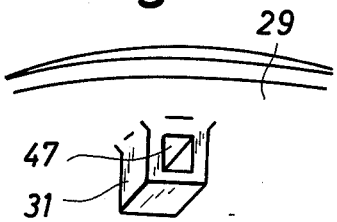
Figure 12:
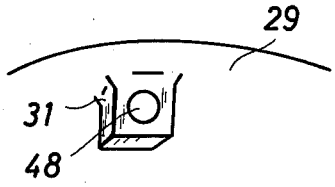
Figure 14:
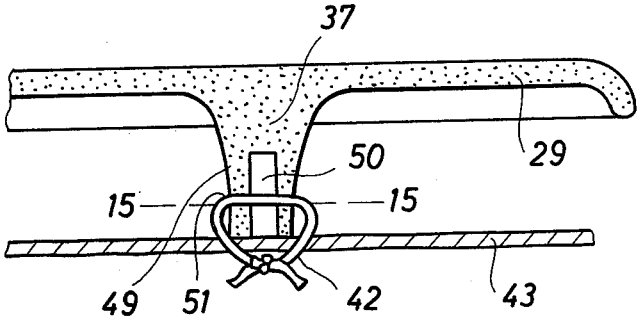
Figure 18:
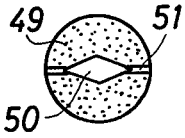
Figure 19:
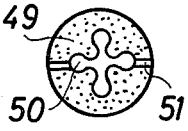
Figure 21:
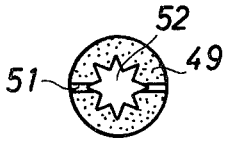
Figure 20:
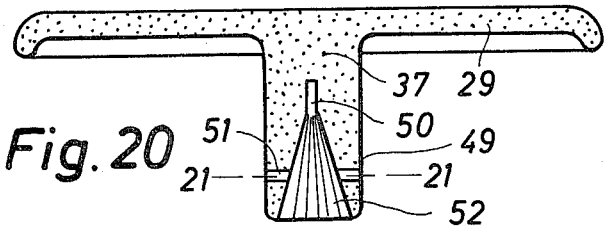
Figure 23:
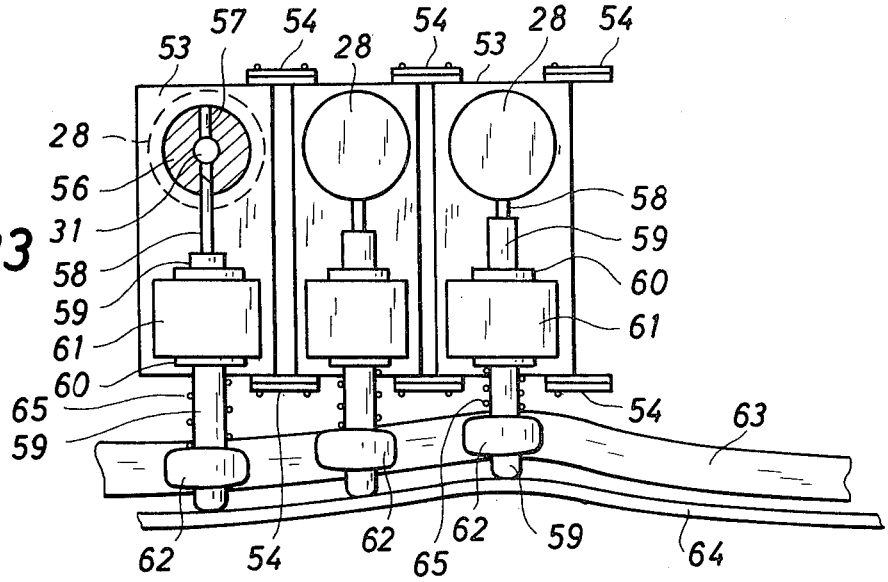
Figure 22:
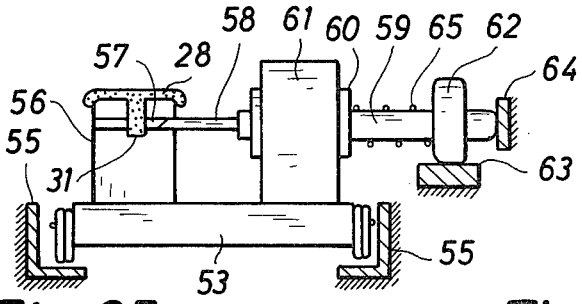
Figure 25:
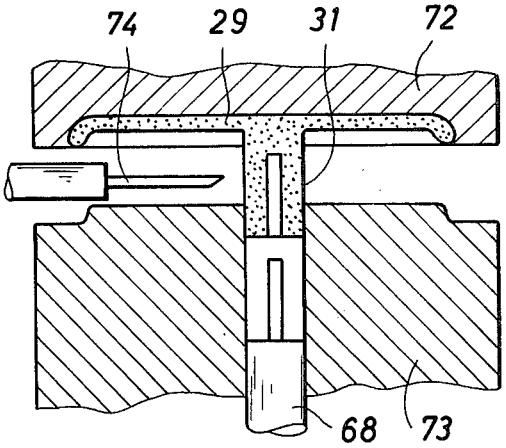
Figure 24:
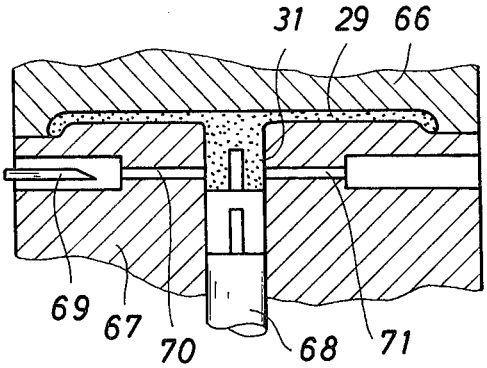

Some embodiments of the plastic insert according to the invention will be described below with reference to the accompanying drawings in which FIG. 1 is a sectional view through a Crown Cork with an insert situated on the beaded mouth of a bottle, FIG. 2 is a plan view of the removed insert, FIG. 3 is a plan view of the insert of FIG. 2 bearing an imprint, FIG. 4 is a perspective view of another insert, FIG. 5 is on a larger scale a sectional view through another insert, FIG. 6 is on a larger scale a sectional view through a third insert, FIG. 7 is an end view of the projection of the insert of FIG. 6, FIGS. 8 to 10 are end views through other inserts, FIGS. 11 and 12 are perspective views of parts of other inserts, FIG. 13 is a sectional view through a further insert, FIG. 14 is a sectional view through a further insert, FIGS. 15 to 19 are sectional views through various inserts taken along the line 15—15 of FIG. 14, FIG. 20 is a longitudinal view through a further insert, FIG. 21 is a cross section taken along the line 21—21 of FIG. 20, FIG. 22 is on a smaller scale an end view of a conveyor with drilling tool, FIG. 23 is a plan view of the conveyor of FIG. 22 with more tools, FIG. 24 is a sectional view through parts of a mould, and FIG. 25 is a sectional view through parts of another mould.

FIG. 1 illustrates a Crown Cork secured to the mouth 26 of a container. The Crown Cork comprises an outer metallic portion 27 and an inner insert 28 of plastics. The insert comprises an upper plate or shield 29, a circular tightening sleeve 30 directed inwards, and a central projection 31 also directed inwards.

This projection 31 is somewhat longer than the height of the sleeve 30, and in the embodiment of the insert illustrated in FIG. 1 the projection 31 has in its free planar end surface 33 a small hole, being only a depression 32. This depression may cooperate with a drawing pin 35, FIG. 5, to be fixed to the insert.

In this manner the insert provided with an imprint 38, FIG. 3, may be secured to a piece of fabric 39 such as a blouse or a shirt, thus serving as a trimming or an emblem, FIG. 5. This figure shows a projection 31, which has a longer hole 34. In FIG. 4 an insert is shown having the depression 32 situated on the side of the projection 31 near the end face 33 of the latter.

Radial slits 40, FIGS. 6 and 7, may extend from the portion of the hole 34 adjacent the free end of the projection 31, whereby the insert will be capable of catching the drawing pin 35, the leg 36 of which is somewhat longer than the hole 6. These slits will also cooperate in catching the leg 36 of the pin and lead it down into the lower portion of the hole 34, from where the point of the leg will penetrate further into the solid projection portion 37.

The inserts illustrated in FIGS. 8 and 9 comprise an oblique through hole 41 extending from a planar part 76 of the side wall of the projection 31 or extending from the planar end 75 of same, which hole 41 may be used for securing either with a drawing pin or a nail or with a thread 42, FIG. 14, drawn through the hole by means of a needle and sewn on a piece of fabric 43, as illustrated in FIG. 14.

The hole of the insert illustrated in FIG. 10 is divided into a central portion 44 and an oblique narrow portion 45 for cooperation with the drawing pin and the needle respectively. This hole thereby comprises a transverse surface 46, through which the leg 36 may penetrate into the solid portion 37 of the projection.

As shown in FIG. 11 the projection 31 may be formed as a cube, and the transverse hole 47 may be rectangular and manufactured by means of a correspondingly formed blanking die, punch or recessing tool.

FIG. 12 shows a laminar projection 31, and the transverse hole 48 may be cast.

Figure 15:
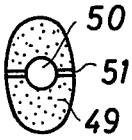

The insert illustrated in FIG. 14 comprises a conical projection 49 having an oval cross section, cf. FIG. 15, and a central hole 50 in addition to the transverse hole, through which the thread 47 is carried. As occasion requires, the hole 51 may be used for the securing of the insert to the blouse 43, as illustrated in FIG. 14, or the longitudinal hole 50 may be used by introducing a drawing pin 35, cf. FIG. 5, or a nail until the point of the drawing pin is pressed firmly into the very thick bottom 37 of the hole 50.

Figure 16:
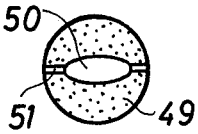

FIG. 16 shows a cross-sectional view through a projection 49 comprising an oval longitudinal hole 50 and a transverse hole 51 extending through the thinnest portions of the wall of the longitudinal hole.

Figure 17:
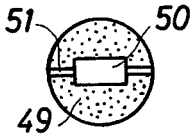

FIG. 17 also illustrates a cross-sectional view of the embodiment of FIG. 16 wherein the cross section of the longitudinal hole 50 is rectangular.

In FIGS. 18 and 19 the cross section of the longitudinal hole 50 is rhombical and clover-leaf shaped respectively, and the transverse hole 51 is carried through the thinnest wall portions of the projection 31.

FIG. 20 shows a longitudinal view through a projection 31, the middle hole 50 of which enlarging towards the free outer end of the projection, and FIG. 21 shows that the enlarged portion 52 of the hole 50 is star-shaped, and that the transverse hole 51 is carried through some of the thinnest portions of the projection wall of the cross section in question.

FIGS. 22 and 23 illustrate how the transverse hole may be drilled into the cap insert 28 while the inserts are transported from the casting machine to the place where they are to be assembled with the metallic portions 27, FIG. 1, of the Crown Cork and where the bottles for instance are applied with caps.

During the above transport the top side of the inserts may be provided with the previously mentioned imprints 38, cf. FIG. 3.

The conveyor comprises a plurality of blocks 53 mutually connected by chain links 54 drawn forwardly on some L-shaped slide bars 55, FIG. 22.

Each block 53 carries a stand 56 catching its insert 28 from some overhead bars, not shown, whereupon the insert is firmly pressed onto the stand 56 during the movement of said stand. The stand comprises a first hole 77 and a coaxial second hole 57 into which a rotating cannula 58 is introduced and drills through the projection 31 of the insert.

The rotation of the cannula is provided by means of a rotating chuck 59 in which it is secured. This chuck 29 may rotate in a bushing 60 in a stock 61 on the block 53.

The chuck 59 carries a friction wheel 62 driving on a friction chute 63 during the transport, whereby the cannula 58 is rotated.

The feed of the cannula is achieved by means of a curved guide 64 pressing against the free end of the chuck 59. The curved guide 64 is formed in such a manner that the cannula is introduced into the hole 77 at an axial speed suitable relative to its rotation. After the drilling operation the cannula 58 travels into the second hole 57 and is then carried back to its starting position influenced by a pressure spring 65 situated around the chuck 59.

FIG. 24 is a vertical sectional view through portions 66 and 67 of a mould for the manufacture of an insert. When the core 68 of the mould has been removed from the cast body a cannula 69 is introduced into the mould portions 67 for penetration of the projection 31 of the subject. During this penetration the cannula is carried into drilling holes 70 and 71.

FIG. 25 illustrates a corresponding sectional view through a mould. The portions 72 and 73 of the mould are easily opened from each other without the subject falling out, and simultaneously the core 68 is removed from the insert.

In this position a cannula 74 may be introduced between the mould portions and penetrate the projection 31 of the insert.

The holes 77, 57, 70 and 71 serve for the control of the cannula during the drilling of the projection for which reason the cannula must have a running fit in these holes, and consequently, the diameter of the inlet hole may be 0.04 mm larger than the outer diameter of the cannula, and the diameter of the outlet hole may be 0.1 mm larger than the diameter of the cannula.

As previously mentioned, the insert may be provided with an imprint 38, cf. FIG. 3, on its top side, i.e. on the side facing the metallic portion of the Crown Cork. This imprint provides the insert with a characteristic look relative to other groups of inserts, and furthermore it may contain information.

Instead of an imprint the shield 29, FIG. 1, of the cap may carry an outer imprint or a decoration, preferably in various colours.

Besides, the insert may be adapted to be used as a trimming without being removed from the metallic portion 27, cf. FIG. 1. Then the imprint must only be made on the outside of the metallic portion 27.

I claim:

1. A bottle cap comprising a dished metallic cap having means for receiving the mouth of a bottle and including a seal comprising a plastic insert having a base removably received and captured in said metallic cap with one side in substantial abutment therewith; a projection extending from the other side of the base; and means on said projection for receiving a fastener whereby said insert may be removed from said metallic cap and fastened by said projection to another object.

2. The combination of claim 1 further including indicia on said base one side.

3. The combination of claim 1 wherein said receiving means comprises a hole.

4. The combination of claim 3 wherein said hole is a depression.

5. The combination of claim 3 wherein said hole extends through said projection.

6. The combination of claim 5 wherein said hole is at an angle to the longitudinal axis of said projection.

7. The combination of claim 5 wherein said hole is a cannula drilled bore.

8. The combination of claim 3 wherein said projection includes a planar surface and said hole is formed in said planar surface.

9. The combination of claim 8 wherein said planar surface is on the end of said projection remote from said base, said end further including rounded edges.

10. The combination of claim 3 wherein said hole is a longitudinally extending hole emerging from the end of the projection remote from said base.

11. The combination of claim 10 wherein the opening of said hole is funnel shaped.

12. The combination of claim 10 wherein said projection includes a plurality of slits extending radially from said hole.

13. The combination of claim 1 wherein said receiving means comprises a first hole in the end of said projection remote from said base and a second hole extending through said projection.

14. The combination of claim 13 wherein said first hole is a depression.

15. The combination of claim 13 wherein said first hole is a longitudinally extending hole.

16. The combination of claim 13 wherein said second hole is at an angle to the longitudinal axis of said projection.

17. The combination of claim 13 wherein said holes intersect.

18. The combination of claim 13 wherein said first hole has a non-circular cross section.

19. The combination of claim 1 further including an integral, cylindrical sleeve of shorter length than said projection extending from said base other side and surrounding said projection and adapted to sealingly engage the interior of the mouth of a bottle.

20. The combination of claim 1 wherein said receiving means comprises a cannula cut hole extending through said projection.

21. A bottle having a mouth and including a dished metallic cap including a seal removably received in said cap and received on said mouth with said seal sealingly engaging said mouth, said seal comprising a plastic insert having a base removably received and captured in said metallic cap with one side in substantial abutment therewith, a projection extending from the other side of the base, and means on said projection for receiving a fastener whereby said insert may be removed from said metallic cap and fastened by said projection to another object.

* * * * *